United States Patent [19]

Matsuo et al.

[11] Patent Number: 4,905,816

[45] Date of Patent: Mar. 6, 1990

[54] TROUGH APPARATUS FOR CONVEYING STEEL BAR MATERIALS TO A COOLING HEARTH

[75] Inventors: Giichi Matsuo; Noburu Masuda; Tamiyasu Kosugi, all of Tokyo, Japan

[73] Assignee: Nippon Kokan Kabushiki Kaisha, Tokyo, Japan

[21] Appl. No.: 165,998

[22] PCT Filed: Dec. 21, 1987

[86] PCT No.: PCT/JP87/01009

§ 371 Date: Jan. 21, 1988

§ 102(e) Date: Jan. 21, 1988

[51] Int. Cl.[4] ..... B65G 47/12

[52] U.S. Cl. ..... 198/448; 414/746.6

[58] Field of Search ..... 198/498, 451, 452, 463.4; 414/748, 745, 745.7

[56] References Cited

U.S. PATENT DOCUMENTS

| | | | |
|---|---|---|---|
| 4,054,047 | 10/1977 | Sclippa | 414/748 X |
| 4,448,298 | 5/1984 | Matsuo | 414/748 X |
| 4,505,374 | 3/1985 | Beerens et al. | 414/748 X |
| 4,711,340 | 12/1987 | Duri | 414/748 X |

FOREIGN PATENT DOCUMENTS

| | | | |
|---|---|---|---|
| 1289813 | 2/1969 | Fed. Rep. of Germany | 414/748 |
| 2153342 | 5/1973 | Fed. Rep. of Germany | 414/748 |
| 0141794 | 5/1980 | German Democratic Rep. | 414/748 |
| 53-17637 | 7/1951 | Japan . | |
| 56-31165 | 7/1981 | Japan . | |
| 7011686 | 2/1972 | Netherlands | 414/748 |

*Primary Examiner*—Robert J. Spar
*Assistant Examiner*—Cheryl Gastineau
*Attorney, Agent, or Firm*—Henry C. Nields

[57] ABSTRACT

The invention provides an apparatus for conveying steel bar materials sent from the exit of a stand of 2 strand rolling line to a cooling hearth, in which improved conveying and dropping of the bar materials is accomplished. Four conveying/dropping components are arranged in two pairs, which are disposed at determined positions, so that the bar materials may avoid being bent or twisted during conveying and dropping, and the treating speed of the rolling line is accelerated.

1 Claim, 5 Drawing Sheets

TROUGH APPARATUS FOR CONVEYING STEEL BAR MATERIALS TO A COOLING HEARTH

TECHNICAL FIELD

The present invention relates to a trough apparatus for conveying to a cooling hearth steel bar materials sent from an exit of a stand of a two-strand steel-bar rolling line.

BACKGROUND OF THE INVENTION

A line table of a cooling hearth to be used in the conventional production of steel bar material is, as shown in FIG. 3, formed with a channel 501 by equilateral angles 500 for conveying products 200 therealong. However, there is a danger that the products 200 will jump out from the channels 501.

Therefore, a trough apparatus for 2 strand high speed rolling as shown in FIGS. 4 and 5 was proposed in Japanese Patent Publication 56-31165 to solve the above mentioned problem. As shown in FIG. 5, a fixed arm 300 is provided at its end with a fixed channel part 302 formed with a semi-circular channel 301. An opening-closing arm 310 is rotatable around a fulcrum 313 and is provided at its end with a moving channel part 312 formed with a similar semi-circular channel 311 in opposition to the channel 301. When the both channels 301, 311 are butted, a conveying trough 320 is formed as a passage 321 of cylindrical space As seen in FIG. 4, the conveying troughs 320 are disposed in parallel and obliquity over a cooling hearth 100, and the arms 310 are rotated around the fulcrums 313. When the opening-closing channels 311 and the fixed channels 302 are separated, the steel bars 200 drop to the cooling hearth 100. In order to let the products 200 drop into grooves 101, 102 of the cooling hearth 100 as demanded, there are provided lower chute plates 330 under the conveying troughes 320 so that the bar products 200 are directed by striking to the lower chutes 330.

A trough apparatus for 1 strand high speed rolling as shown in FIGS. 6 and 7 was proposed in Japanese Utility Model 53-17637. As shown in FIG. 7, an arm 340 projects laterally from a column 700. The arm 340 is provided at its end with a fixed channel part 342 having a semi-circular channel 341 facing downwardly. An opening-closing U-shaped arm 350 is rotatable around a fulcrum 353, and the arm 350 is provided at its end with a moving channel 352 having a semi-circular channel 351 facing upwardly toward the channel 341. When both channels 342, 352 are butted, a conveying trough 360 is formed as a passage 361 of cylindrical space. As seen in FIG. 6, the conveying troughs 360 are disposed upwardly of the cooling hearth 100, and the arms 350 are rotated around the fulcrums 353. When the channels 351 and the channels 341 are separated, the steel bars 200 roll on chuting plates 370 and along auxiliary guides 380, and drop onto the cooling hearth 200.

However, the first mentioned conveying trough apparatus was involved with the following problems:

(1) Due to thermal expansions in the channel parts 302, 312 at the ends of the fixed arm 300 and the opening-closing arm 310, a gap is caused in position as seen in FIGS. 8(*a*)(*b*) between the channels 301, 311, and the bar product 200 is injured by the edges of these gapped channels 301, 311.

(2) The products 200 must be conveyed to adjacent individual grooves 101, 102 of the cooling hearth 100, and each product 200 is directed by dropping it from a trough 320 so that it collides with a chute 320, and is conveyed to one of the grooves 101, 102. However, since the product has a length of over several tens of meters, it does not always drop evenly at the front and rear ends and the timing of collisions with the chute 320 vary among the parts of the product 200, thereby causing bending or twisting.

(3) If the bottom face of the conveying trough 320 has a V shape of moderate gradient (when the moving channel 312 is closed during movement of the products along the conveying trough 320) then, when a product 200 having an inferior rolled property (especially straight) is dropped, the product 200 is caught by the fixed channel 301, thereby causing bending or twisting.

The second-mentioned apparatus was involved with the following problems:

(4) The bar lengths 200 which have passed through the 2 strand concurrent rolling and have been cut into bar lengths are not dropped together, but a bar length 200 from one strand is held in a trough 360 (while a bar length 200 from the other strand is dropped into one of the grooves 101 or 102 of the cooling hearth 100) by delaying the dropping timing. But in this case, since subsequent products 200 are sent continuously, a problem occurs about the time cycle. That is, the treating cycle per bar length to be sent to the cooling hearth 100 must be extended by the staying time in the trough; otherwise the arriving products 200 could not be conveyed in and out successively. Methods for extending the treating time per bar length include delaying the rolling speed and enlarging the product in length. However, the former would decrease productivity and the latter would cause trouble in bending the products 200 because the length of each bar length is enlarged, and inconveniences such as rising costs of facilities, buildings and others may be expected.

(5) The possibility of conveying two products 200 into one groove 101 or 102 of the cooling hearth 100 at the same time has been considered, but taking into consideration twisting or bending of the product, this method is out of questions. As shown in FIGS. 9(*a*), (*b*), (*c*), the two products are twisted or bent within one groove 101 or 102.

The invention has been designed to solve the above mentioned problems, and to send the rolled products while keeping them straight, to minimize the dropping distance of the rolled products of the two strands into the groove, and to avoid twisting of the products by dropping.

DISCLOSURE OF THE INVENTION

FIG. 1 shows a structure of a trough apparatus for conveying two-strand steel bar materials to a cooling hearth according to the invention.

The apparatus of FIG. 1 comprises four troughs 1*a* to 1*d* having flat plates 2, opening-closing channel arms 3 and driving devices 6.

The flat plates 2 are provided in obliquity toward a cooling hearth 100, and the channel arms 3 are rotatably pivoted above the flat plates 2.

Each channel arms 3 is provided at its end with a U-shaped part 4. When a U-shaped part 4 contacts a flat plate 2, a channel 5 is formed for conveying the steel bar material.

The drive device 6 rotates the channel arm 3 about said pivot.

The troughs 1*a* to 1*d* are arranged vertically and are divided into two couples, one couple being displaced horizontally with respect to the other couple.

Further, in this apparatus, the channel arm 3 is rotated toward the flat plate 2 by the drive device 6 during conveying of the product 200, so that the U-shaped part 4 is pressed against the flat plate 2. Therefore, the channel 5 is provided for conveying the steel bar along the inner sides of the flat plate 2 and the U-shaped part 4. Two bar-lengths 200, 200 which have been completed in the 2 strand rolling operation and sent together, are simultaneously conveyed into the channels 5, 5 of the troughs 1*a* and 1*c* (or, alternatively, the troughs 1*a* and 1*d*), or the channels 5, 5 of the troughs 1*b* and 1*d* (or, alternatively, the troughs 1*b* and 1*c*). The channel arms 3, 3 of the troughs 1*a*, 1*c* or 1*b*, 1*d* (or the troughs 1*a*, 1*d* or 1*b*, 1*c*) are raised upwardly. When the U-shaped parts 4, 4 and the flat plates 2, 2 are separated, the two bar-lengths 200, 200 are dropped into the grooves 101 and 102 individually. Subsequent bar-lengths 200, 200 are respectively sent to different channels 5, 5 of troughs 1*b*, 1*d* or 1*a*, 1*c* (or the troughs 1*b*, 1*c* or 1*a*, 1*d*) and dropped into the grooves 101, 102 in the same sequence. Thus, the bar-lengths 200, 200 are alternately dropped into the grooves 101, 102 of the cooling hearth 100 from the conveying troughs 1*a*, 1*c* and 1*b*, 1*d* (or conveying troughs 1*a*, 1*d* or 1*b*, 1*c*)

Figure 1:
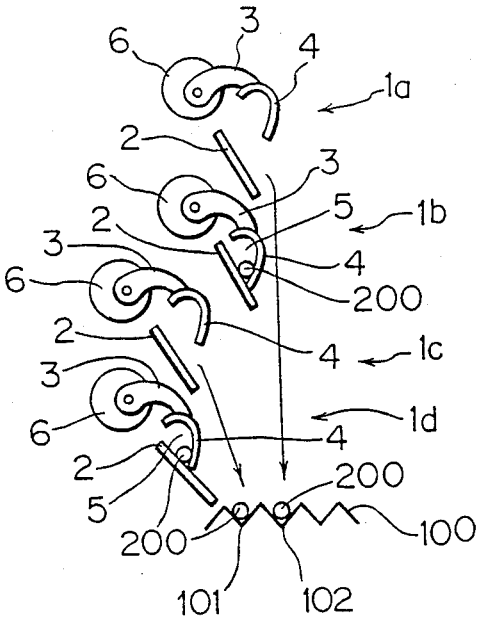
FIG. 1 is an outline view showing a structure of the invention.
Figure 3:
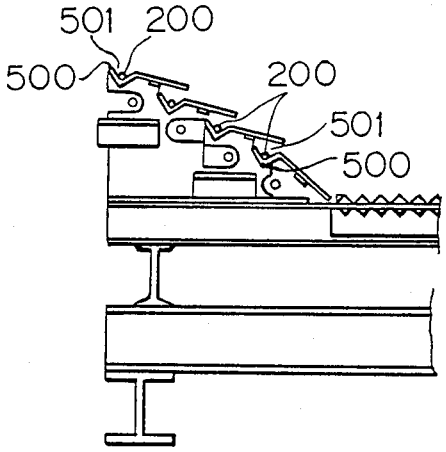
FIG 3 PRIOR ART
FIG. 3 is a side view showing a line table of a cooling hearth of a conventional rolling facility.
Figure 5:
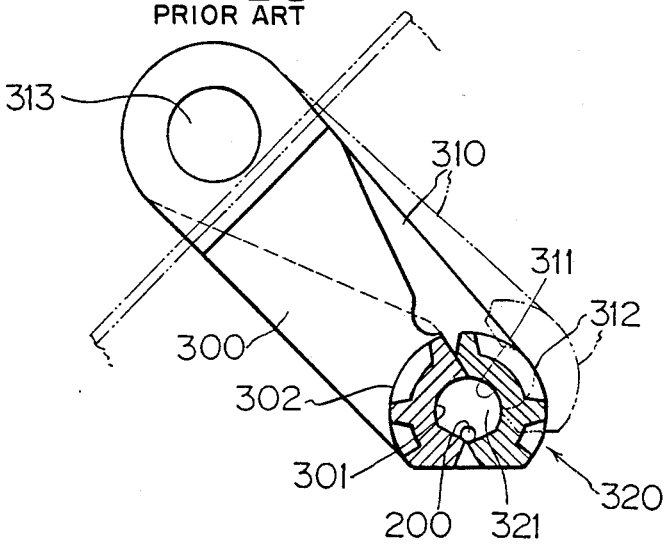
FIG 5 PRIOR ART
FIG. 5 is a partially enlarged view of the trough of FIG. 4.

In the drawings, 1*a*, 1*b*, 1*c*, 1*d*, 11, 12, 13, 14 are conveying troughs; 2, 20 are flat plates; 3, 30 are opening-closing channels; 4, 40 are U-shaped parts; 5, 50 are channels; and 6, 60 are drive devices.

EMBODIMENTS FOR PRACTISING THE INVENTION

An explanation will be made of one embodiment of the invention.

Figure 2:
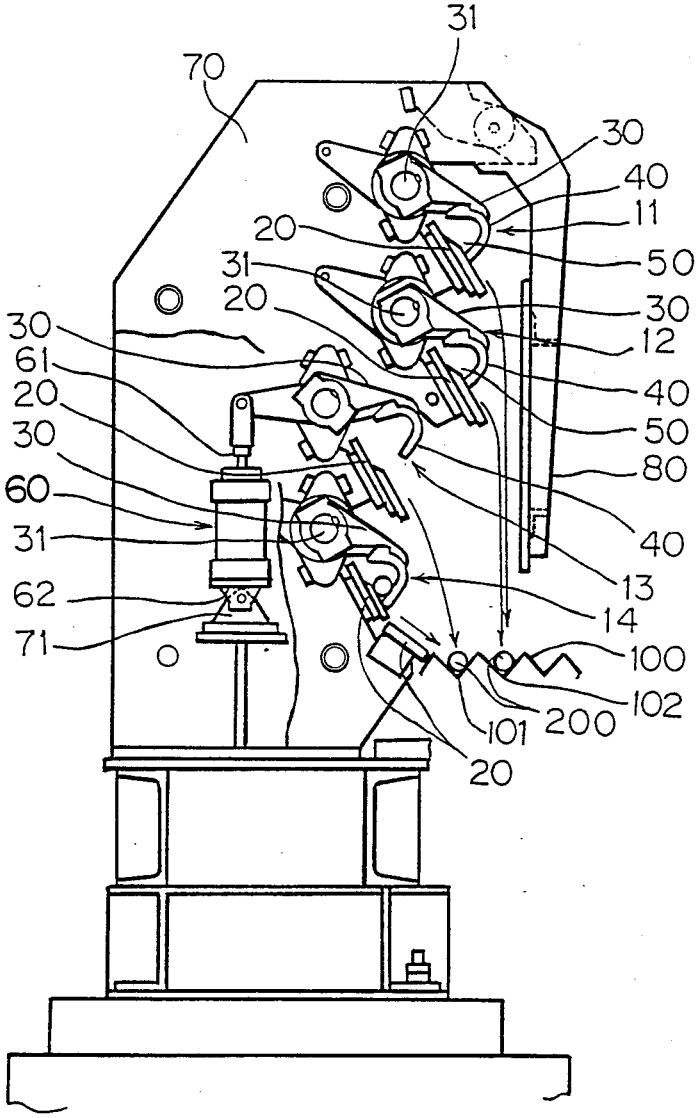
FIG. 2 is an explanatory view showing one embodiment of the invention.
Figure 4:
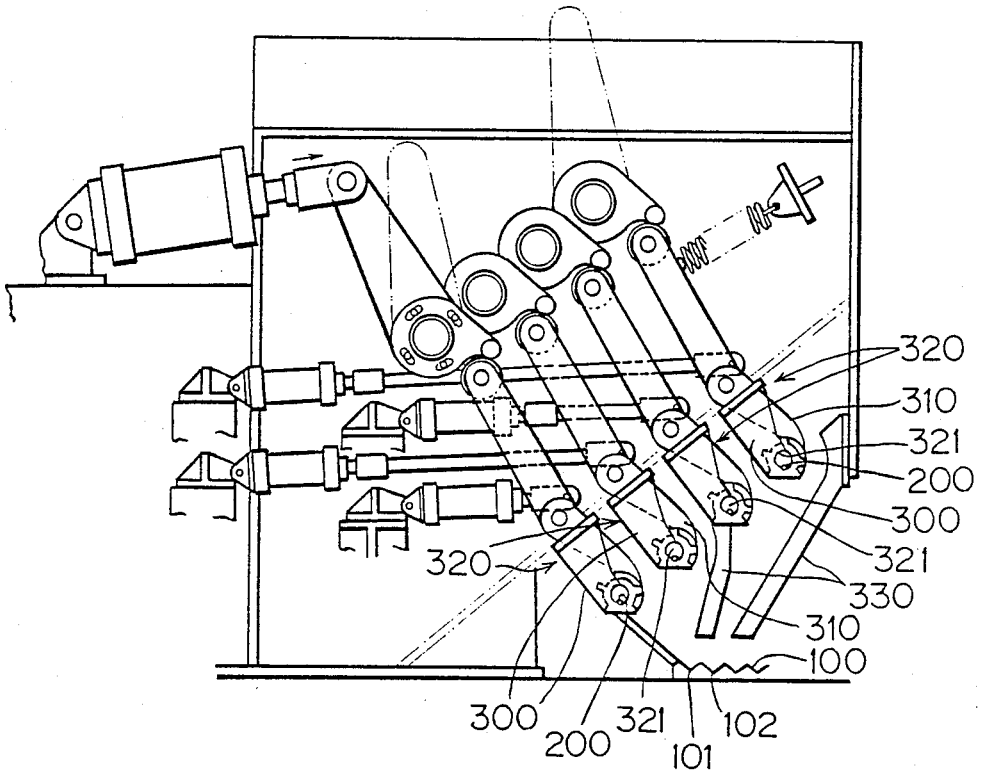
FIG 4 PRIOR ART
FIG. 4 is a side view of part of a known conveying trough apparatus for high speed rolling in 2 strand apparatus.
Figure 6:
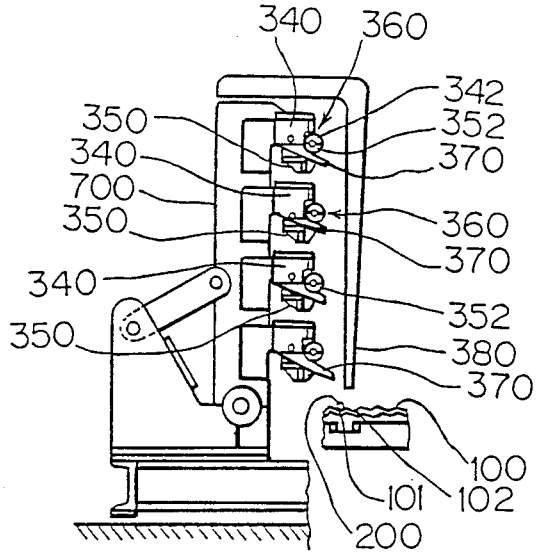
FIG 6 PRIOR ART
FIG. 6 is a side view of a known conveying trough apparatus for high speed rolling in 1 strand apparatus.
Figure 7:
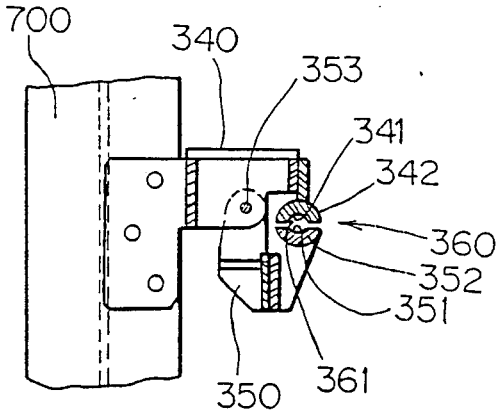
FIG 7 PRIOR ART
FIG. 7 is a partially enlarged view of the trough of FIG. 6.
Figure 8A:
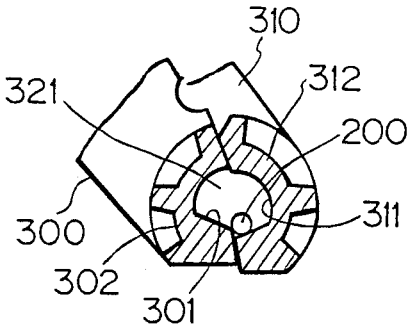
FIG 8(a) PRIOR ART
FIGS. 8(*a*)(*b*) are explanatory views showing left and right channel parts gapped in position due to thermal expansion.
Figure 8B:
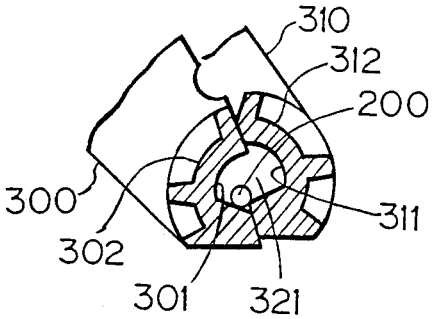
FIG 8(b) PRIOR ART
Figure 9A:
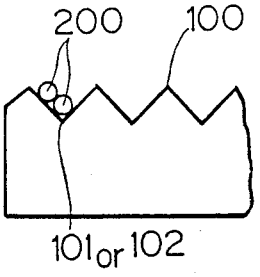
FIG 9(a) PRIOR ART
FIGS. 9(*a*)(*b*)(*c*) are explanatory views showing twisting and bending caused when two products are conveyed and dropped together into a groove of the cooling hearth.
Figure 9B:
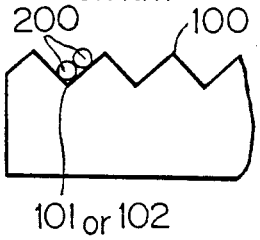
FIG 9(b) PRIOR ART
Figure 9C:
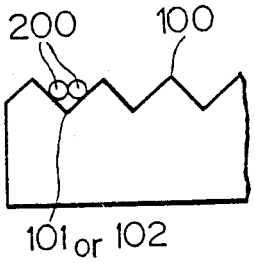
FIG 9(c) PRIOR ART

FIG. 2 is an explanatory view showing the structure of an apparatus according to the invention in a two-strand steel-bar rolling line, where 70 is a support stand, and 100 is a cooling hearth.

The apparatus of the present inventive comprehends of four conveying troughs 11 to 14 which are arranged vertically and divided into two pairs of the troughs namely a first pair 11, 12 and a second pair 13, 14. This vertical arrangement of each of the pairs is displaced in the horizontal direction and installed at the support stand 70 at the upper part of the cooling hearth.

Each of the troughs 11 to 14 is provided with a flat plate 20 tilted toward the cooling hearth 100 and secured to the support stand 70; and opening-closing channel 30 of two arms pivoted to the support stand 70 rotatable around an axis 31 at the upper part of the flat plate; and a drive device 60 (omitted with respect to others than the conveying trough 13) comprising a hydraulic cylinder, a rod 61 which is connected to one end of the channel arm 30, and a base 62 which is pivoted to an eye plate 71 on the support stand 70. The channel arm 30 is provided at its other end with a U-shaped part 40 toward the face side of the flat plate 20, and when the U-shaped part 40 contacts the flat plate 20, a steel bar conveying channel 50 is formed at the inner sides thereof.

Numeral 80 designates an auxiliary guide suspended from the upper part of the support along the tilting side.

A further explanation will be made of operation of the above mentioned apparatus, as follows:

The drive device 60 extends the rod 61 to rotate the channel arm 30 clockwise around the axis 31 and press the U-shaped part 40 to the flat plate 20, and conveys rolled bar products 200 through the channel 50 formed at the inner sides of the flat plate 20 and the U-shaped part 40. The two bar products 200, 200 which have been rolled concurrently in the 2 strands are conveyed via the channels 50, 50 of the upper and lower conveying troughes 11 and 13.

Thereafter, the rods 61, 61 of the drive devices 60, 60 are retracted, and the channel arms 30, 30 are rotated counterclockwise so that the U-shaped parts 40, 40 are separated from the flat plates 20, 20, and the bar materials 200, 200 roll along the tilting surfaces of the flat plates 20, 20 and drop into the grooves 101, 102 of the cooling hearth 100.

The subsequently ensuing two products 200, 200 are conveyed through the channels 50, 50 of the upper and lower troughs 12 and 14, and drop into the grooves 101, 102 in the same sequence as said above. Such an operation is repeated.

By the present structure, the aforesaid problems of the prior art have been all removed, as follows:

I. The U-shaped part of the channel arm is always pressed to the flat plate during conveying of the products, and if a gap is caused at the contact between the flat plate and the U-shaped part due to the thermal expansion, the problem (1) of the prior art does not occur since the products contact to them under the same condition as before the thermal expansion.

II. With respect to the problem (2), the products do not collide against the chute plate in order to be directed to the grooves of the cooling hearth, but drop directly into the grooves without bending or twisting.

III. The flat plate and the channel arm having the U-shaped part are combined, so that the products are not caught by the stationary side when dropping, and bending or twisting are not caused, and therefore the conventional problem (3) is solved.

IV. with respect to the problem (4), since it is possible to convey two bar lengths simultaneously and convey them into each of the grooves one by one, it is no longer required to extend the treating cycle.

V. Since the two products which are conveyed simultaneously drop into the adjacent different grooves respectively, the problem (5) has been solved.

INDUSTRIAL APPLICATION

The present apparatus according to the invention is used to convey to a cooling hearth steel bar materials sent from the exit of a stand of a 2 strand rolling line in such a manner as to keep the bar products straight and to shorten the dropping distance of the bar material into the groove of the cooling hearth, thereby to avoid the bending and twisting of the product which have been problems in the prior art.

What is claimed is:

1. A trough apparatus for conveying steel bar materials to a cooling hearth in a two-strand rolling line comprising four conveying troughs; each of said troughs comprising in combination a flat plate fixed in obliquity with respect to the cooling hearth; pivot means at an upper part of the flat plate; an opening-closing channel arm which is rotatably pivoted at said pivot means and having a U-shaped part at its end which is adapted to form a channel for conveying steel bar materials when the U-shaped part contacts the flat plate; and a driving device for rotating the arm around said pivot means; the four conveying troughs being arranged in the form of two pairs, one of said pairs being an upper pair of troughs and the other of said pairs being a lower pair of troughs, each of said pairs of troughs having an upper and a lower trough with each upper trough being horizontally aligned with but located above the respective lower trough of each said pair; each of the troughs of the upper pair of troughs being located above each of the troughs of the lower pair of troughs but horizontally displaced relative thereto wherein any bar materials dropped from the upper trough of a pair will clear the lower trough of the pair.

* * * * *